US005924736A

United States Patent [19]

Russo

[11] Patent Number: 5,924,736

[45] Date of Patent: Jul. 20, 1999

[54] ORGANIZING AND PLANNING DEVICE FOR WEDDINGS

[76] Inventor: Giacomo Russo, 42 White Oak Ridge Rd., Lincroft, N.J. 07738

[21] Appl. No.: 08/870,055

[22] Filed: Jun. 5, 1997

[51] Int. Cl.[6] ..... B42F 3/00; B42F 5/00; B42F 21/00

[52] U.S. Cl. ..... 281/38; 281/31; 281/28; 281/22; 281/15.1; 402/70; 402/73; 402/79; 402/80 R; 283/38; 283/42; 283/36

[58] Field of Search ..... 281/22, 15.1, 16, 281/28, 29, 30, 31, 38, 19.2, 34, 35; 402/70, 79, 73, 80 R, 57; 283/36, 37, 38, 39, 40, 41, 42, 43, 61, 62; 40/641

[56] References Cited

U.S. PATENT DOCUMENTS

| | | | |
|---|---|---|---|
| Re. 29,422 | 10/1977 | Cunningham . | |
| 1,743,512 | 1/1930 | Aisen | 281/30 |
| 4,232,461 | 11/1980 | Crawford . | |
| 4,247,999 | 2/1981 | Latino . | |
| 4,575,126 | 3/1986 | Grubbs | 283/38 |
| 4,784,508 | 11/1988 | Shannon | 283/36 |
| 4,973,184 | 11/1990 | Le Salle | 281/15.1 |
| 5,031,935 | 7/1991 | D'Andrea | 281/15.1 |
| 5,294,208 | 3/1994 | Tremmel, Jr. et al. | 281/15.1 |
| 5,346,326 | 9/1994 | Bienvenu | 281/15.1 |
| 5,417,509 | 5/1995 | Schwartz | 281/28 |
| 5,489,120 | 2/1996 | Thornburg . | |
| 5,513,457 | 5/1996 | Byrnes et al. | 283/37 |
| 5,527,069 | 6/1996 | Bianco | 281/29 |
| 5,590,911 | 1/1997 | Wilson | 283/37 |

*Primary Examiner*—Frances Han

[57] ABSTRACT

A new Organizing and Planning Device For Weddings for providing a convenient system for organizing the multitude of information associated with planning a wedding. The inventive device includes a binder including a back cover, a front cover, and a spine portion hingedly joining the back cover and the front cover wherein the binder further includes a plurality of openable retaining rings mounted to the spine portion thereof. A plurality of pocketed dividers, a plurality of notational information sheets, a reference calendar, a plurality of monthly planning calendars, and a plurality of tabbed dividers are each removably and replacably retained in the binder by the plurality of openable retaining rings. Each of the plurality of pocketed dividers corresponds to an element of the wedding occasion.

1 Claim, 4 Drawing Sheets

ORGANIZING AND PLANNING DEVICE FOR WEDDINGS

BACKGROUND OF THE INVENTION

1. Field of the Invention

The present invention relates to organizing devices and more particularly pertains to a new Organizing and Planning Device For Weddings for providing a convenient system for organizing the multitude of information associated with planning a wedding.

2. Description of the Prior Art

The use of organizing devices is known in the prior art. More specifically, organizing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art organizing devices include U.S. Pat. No. 4,887,373; U.S. Pat. No. 4,798,402; U.S. Pat. No. D339,821; U.S. Pat. No. 4,488,366; U.S. Pat. No. 5,016,917; and U.S. Pat. No. 5,339,546.

While these devices fulfill their respective, particular objectives and requirements, the aforementioned patents do not disclose a new Organizing and Planning Device For Weddings. The inventive device includes a binder including a back cover, a front cover, and a spine portion hingedly joining the back cover and the front cover wherein the binder further includes a plurality of openable retaining rings mounted to the spine portion thereof. A plurality of pocketed dividers, a plurality of notational information sheets, a reference calendar, a plurality of monthly planning calendars, and a plurality of tabbed dividers are each removably and replacably retained in the binder by the plurality of openable retaining rings. Each of the plurality of pocketed dividers corresponds to an element of the wedding occasion.

In these respects, the Organizing and Planning Device For Weddings according to the present invention substantially departs from the conventional concepts and designs of the prior art, and in so doing provides an apparatus primarily developed for the purpose of providing a convenient system for organizing the multitude of information associated with planning a wedding.

SUMMARY OF THE INVENTION

In view of the foregoing disadvantages inherent in the known types of organizing devices now present in the prior art, the present invention provides a new Organizing and Planning Device For Weddings construction wherein the same can be utilized for providing a convenient system for organizing the multitude of information associated with planning a wedding.

The general purpose of the present invention, which will be described subsequently in greater detail, is to provide a new Organizing and Planning Device For Weddings apparatus and method which has many of the advantages of the organizing devices mentioned heretofore and many novel features that result in a new Organizing and Planning Device For Weddings which is not anticipated, rendered obvious, suggested, or even implied by any of the prior art organizing devices, either alone or in any combination thereof.

To attain this, the present invention generally comprises a binder including a back cover, a front cover, and a spine portion hingedly joining the back cover and the front cover wherein the binder further includes a plurality of openable retaining rings mounted to the spine portion thereof. A plurality of pocketed dividers, a plurality of notational information sheets, a reference calendar, a plurality of monthly planning calendars, and a plurality of tabbed dividers are each removably and replacably retained in the binder by the plurality of openable retaining rings. Each of the plurality of pocketed dividers corresponds to an element of the wedding occasion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Organizing and Planning Device For Weddings apparatus and method which has many of the advantages of the organizing devices mentioned heretofore and many novel features that result in a new Organizing and Planning Device For Weddings which is not anticipated, rendered obvious, suggested, or even implied by any of the prior art organizing devices, either alone or in any combination thereof.

It is another object of the present invention to provide a new Organizing and Planning Device For Weddings which may be easily and efficiently manufactured and marketed.

It is a further object of the present invention to provide a new Organizing and planning Device For Weddings which is of a durable and reliable construction.

An even further object of the present invention is to provide a new Organizing and Planning Device For Weddings which is susceptible of a low cost of manufacture with regard to both materials and labor, and which accordingly is then susceptible of low prices of sale to the consuming public, thereby making such Organizing and Planning Device For Weddings economically available to the buying public.

Still yet another object of the present invention is to provide a new Organizing and Planning Device For Weddings which provides in the apparatuses and methods of the prior art some of the advantages thereof, while simultaneously overcoming some of the disadvantages normally associated therewith.

Still another object of the present invention is to provide a new Organizing and Planning Device For Weddings for providing a convenient system for organizing the multitude of information associated with planning a wedding.

Yet another object of the present invention is to provide a new Organizing and Planning Device For Weddings which includes a binder including a back cover, a front cover, and a spine portion hingedly joining the back cover and the front cover wherein the binder further includes a plurality of openable retaining rings mounted to the spine portion thereof. A plurality of pocketed dividers, a plurality of notational information sheets, a reference calendar, a plurality of monthly planning calendars, and a plurality of tabbed dividers are each removably and replacably retained in the binder by the plurality of openable retaining rings. Each of the plurality of pocketed dividers corresponds to an element of the wedding occasion.

Still yet another object of the present invention is to provide a new Organizing and Planning Device For Weddings that permits convenient recording of pertinent information and storing of important documents, such as contracts, in one location where they can be easily located.

Even still another object of the present invention is to provide a new Organizing and Planning Device For Weddings that is compact, easy to transport, and available in various sizes.

Even still another object of the present invention is to provide a new Organizing and Planning Device For Weddings that can be kept as a cherished keepsake of the wedding.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
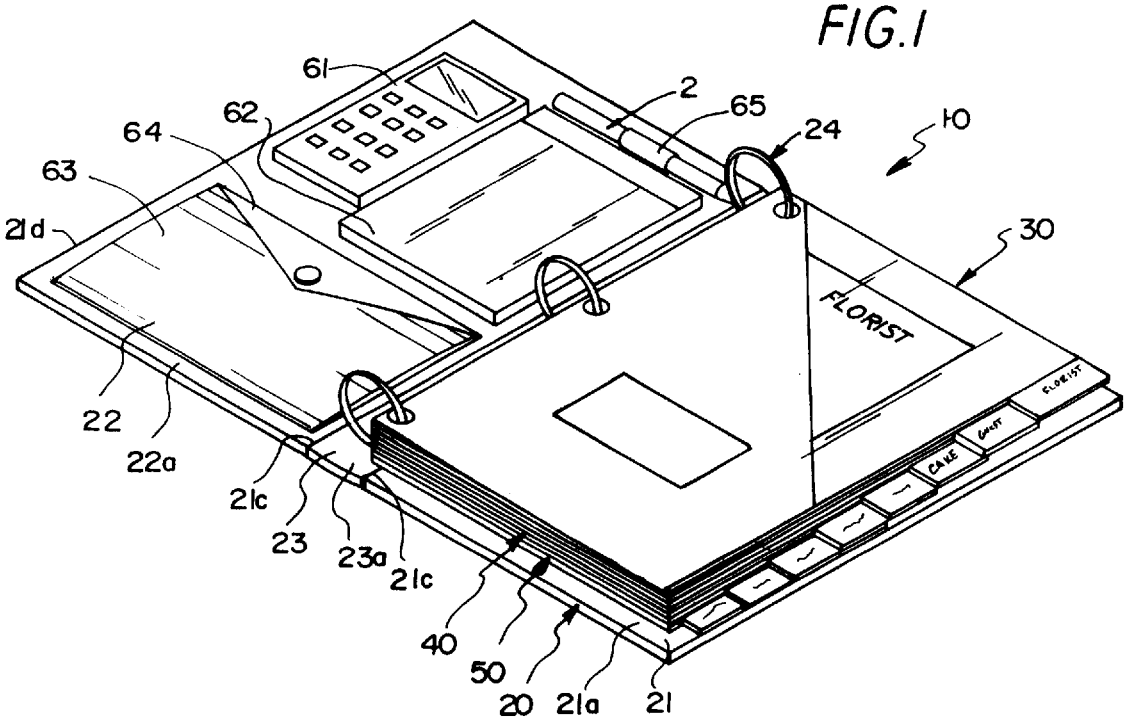
FIG. 1 is an illustration of a new Organizing and Planning Device For Weddings according to the present invention.

With reference now to the drawings, and in particular to FIGS. 1 through 8 thereof, a new Organizing and Planning Device For Weddings embodying the principles and concepts of the present invention and generally designated by the reference numeral 10 will be described.

More specifically, it will be noted that the Organizing and Planning Device For Weddings 10 comprises a binder 20 including a back cover 21, a front cover 22, and a spine portion 23 hingedly joining the back cover 21 and the front cover 22 wherein the binder 20 further includes a plurality of openable retaining rings 24 mounted to the spine portion 23 thereof. A plurality of pocketed dividers 30, a plurality of notational information sheets 40, a reference calendar 50, a plurality of monthly planning calendars 55, and a plurality of tabbed dividers 70 are each removably and replacably retained in the binder 20 by the plurality of openable retaining rings 24. Each of the plurality of pocketed dividers 30 corresponds to an element of the wedding occasion.

Figure 2:
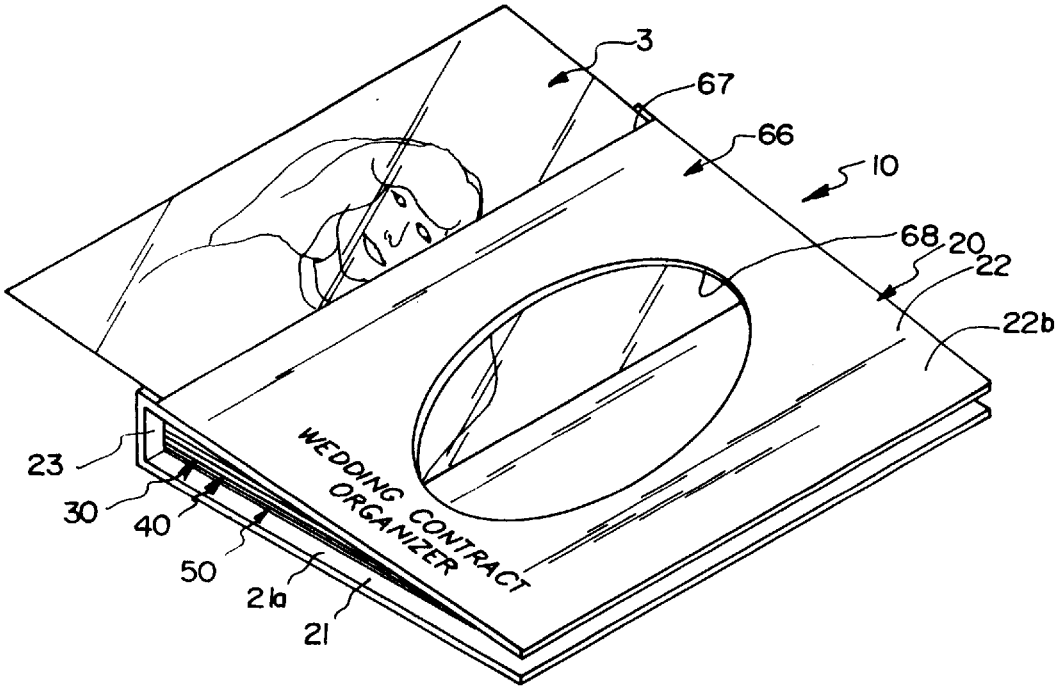
FIG. 2 is an illustration of the cover of the present invention.

As best illustrated in FIGS. 1 and 2, it can be shown that the back cover 21 and the front cover 22 each have an inner surface 21*a* and 22*a*, respectively, an outer surface 21*b* and 22*b*, respectively, an inner edge 21*c* and 22*c*, respectively, and an outer edge 21*d* and 22*d*, respectively. The spine portion 23 has an inner surface 23*a* and an outer surface 23*b* and hingedly joins the back cover 21 and the front cover 22 along the inner edges 21*c* and 22*c* thereof. The front cover 22 and the back cover 21 are openable between a closed position wherein the inner surfaces 21*a* and 22*a* thereof face each other and a open position wherein the outer surfaces 21*b* and 22*b* thereof face downward.

The plurality of openable retaining rings 24 are mounted to the inner surface 23*a* of the spine portion 23 of the binder 20. The plurality of openable retaining rings 24 permit independent removal and replacement of each of the plurality of pocketed dividers 30, the plurality of notational information sheets 40, and the planning calendar 50.

A calculator 61, a notepad 62, at least one storage pocket 63, and a loop 65 for holding a writing instrument 2 are provided on the inner surface 22*a* of the front cover 22. The storage pocket 63 includes a closure flap 64 for retaining items placed therein. A photo sleeve 66 is provided on the outer surface 22*b* of the front cover 22. The photo sleeve 66 has an opening 67 along one side thereof that allows for insertion of a photograph 3 into the photo sleeve 66. The photo sleeve 66 has a window 68 therein that permits viewing of a photograph 3 when inserted in the photo sleeve 66.

Figure 3:
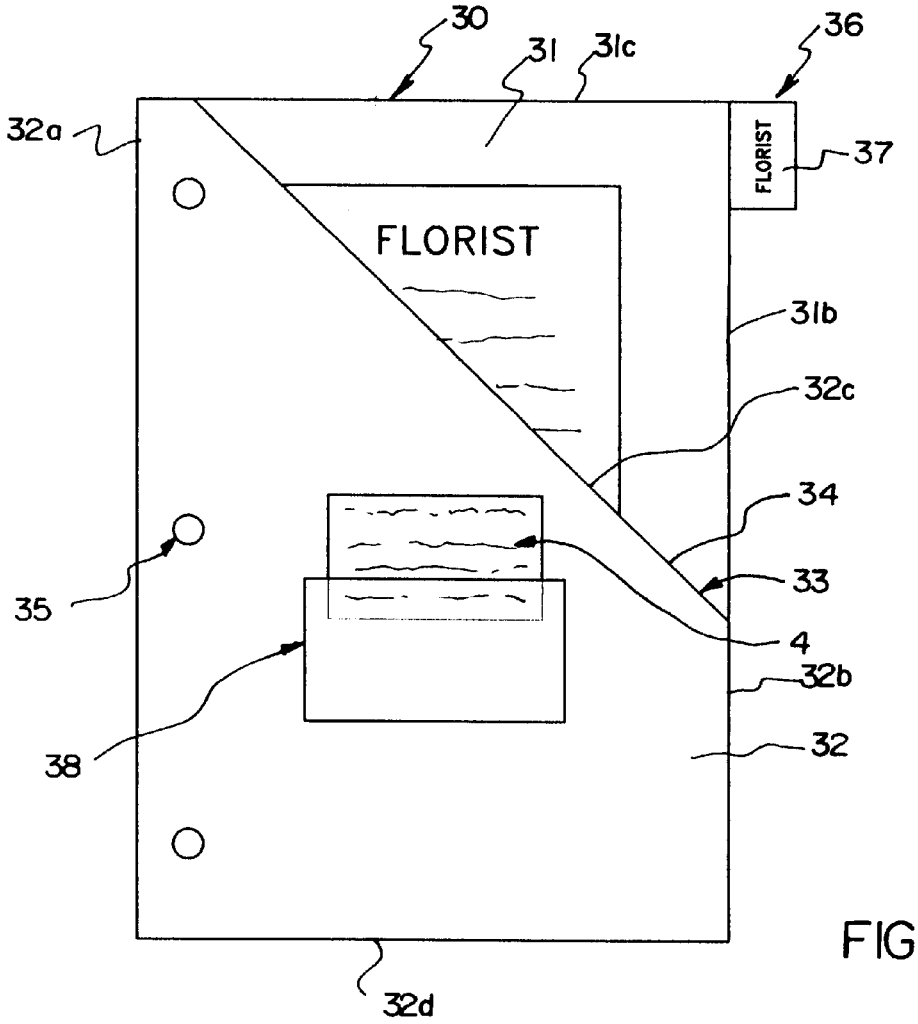
FIG. 3 is an illustration of one of the plurality of pocketed dividers of the present invention.

As best illustrated in FIG. 3, it can be shown that each of the plurality of pocketed dividers 30 comprises a full back panel 31 and a partial front panel 32 joined in a manner to form a pocket 33. The full back panel 31 and the partial front panel 32 each have an inner edge 31*a* and 32*a*, respectively, an outer edge 31*b* and 32*b*, respectively, a top edge 31*c* and 32*c*, respectively, and a bottom edge 31*d* and 32*d*, respectively. The full back panel 31 and the partial front panel 32 are joined along the inner edges 31*a* and 32*a*, outer edges 31*b* and 32*b*, and bottom edges 31*d* and 32*d* thereof to form the pocket 33 wherein the top edge 32*c* of the partial front panel 32 forms an opening 34 for the pocket 33.

Each of the plurality of pocketed dividers 30 corresponds to an element of the wedding occasion wherein the elements of the wedding occasion include the following:

CEREMONY
DRESSES/TUXEDOS
GUESTS
FLORIST
PRINTER
PHOTOGRAPHER
VIDEOGRAPHER
RECEPTION
CATERER
CAKE
ENTERTAINMENT
HONEYMOON
MISCELLANEOUS

The full back panel 31 and the partial front panel 32 each have a plurality of aligned holes 35 therein along the inner edges 31*a* and 32*a* thereof. Each of the plurality of aligned holes 35 corresponds to one of the plurality of openable retaining rings 24. The full back panel 31 of each of the plurality of pocketed dividers 30 includes a tab 36 disposed along the outer edge 31*b* thereof. Each tab 36 is vertically offset from adjacent tabs in a manner so as to avoid complete overlap thereof. Each tab 36 has indicia 37 thereon corresponding to one of the elements of the wedding occasion.

Figure 4:
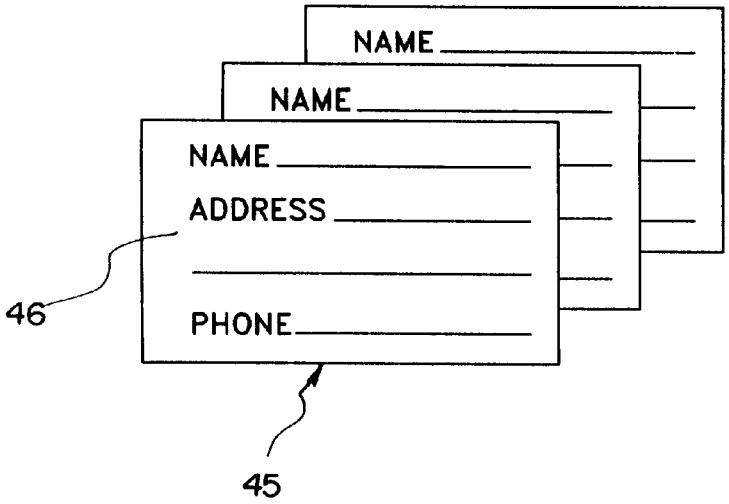
FIG. 4 is an illustration of one of the plurality of notational information cards of the present invention.

A business card pocket 38 adapted for displaying a business card 4 is provided on the partial front panel 32 of each of the plurality of pocketed dividers 30. As best illustrated in FIG. 4, it can be shown that a plurality of notational information cards 45 each adapted for insertion into the business card pocket 38 are provided. Each of the plurality of notational information cards 45 have indica 46 thereon identifying notational categories and include an area adjacent thereto for accepting notational information. The notational categories include name, address, and telephone number.

Figure 5:
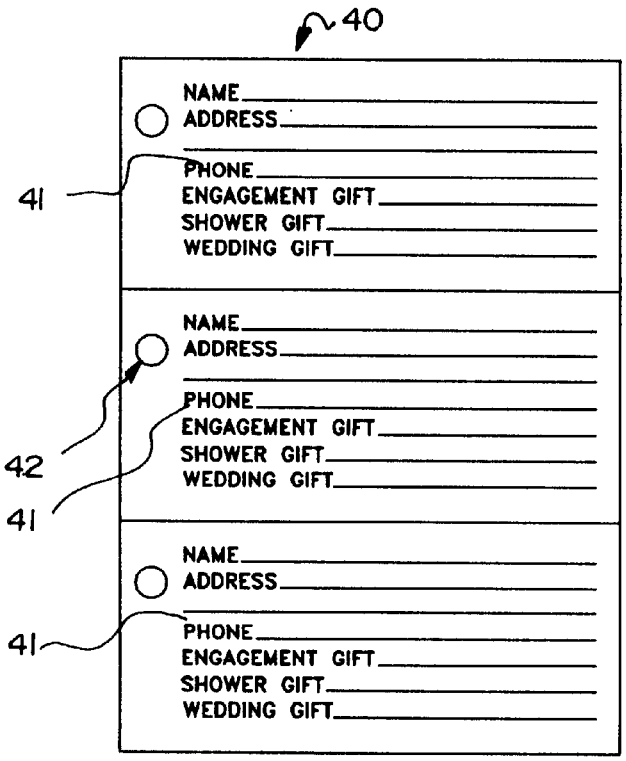
FIG. 5 is an illustration of one of the plurality of notational information sheets of the present invention.

As best illustrated in FIG. 5, it can be shown that each of the plurality of notational information sheets 40 have indicia 41 thereon identifying notational categories and include an area adjacent thereto for accepting notational information. The notational categories include name, address, telephone number, engagement gift, shower gift, and wedding gift. Each of the plurality of notational information sheets 40 has a plurality of aligned holes 42 therein along an inner edge thereof. Each of the plurality of aligned holes 42 corresponds to one of the plurality of openable retaining rings 24.

Figure 6:
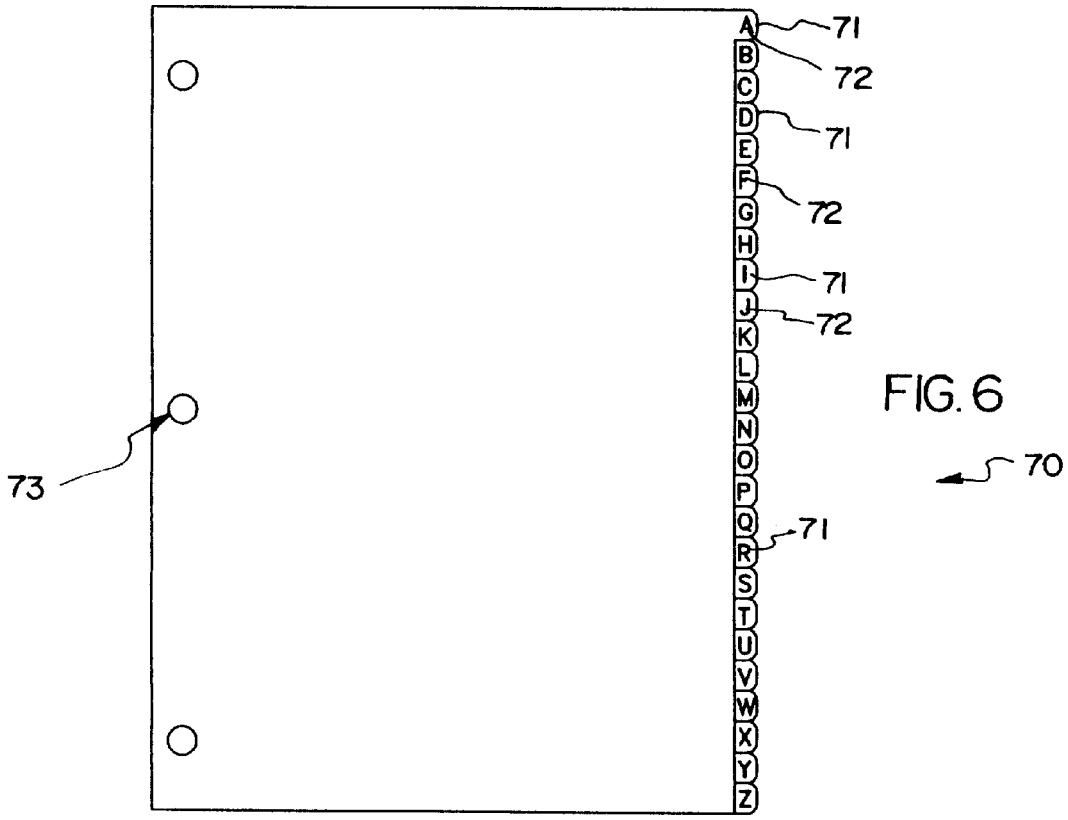
FIG. 6 is an illustration of the plurality of tabbed dividers of the present invention.

As best illustrated in FIG. 6, it can be shown that each of the plurality of tabbed dividers 70 includes a tab 71 disposed along an outer edge thereof. Each tab 71 is vertically offset from adjacent tabs in a manner so as to avoid complete overlap thereof. Each tab 71 has indicia 72 thereon corresponding to a letter of the alphabet. Each of the plurality of tabbed dividers 70 has a plurality of aligned holes 73 therein along an inner edge thereof. Each of the plurality of aligned holes 73 corresponds to one of the plurality of openable retaining rings 24.

Figure 7:
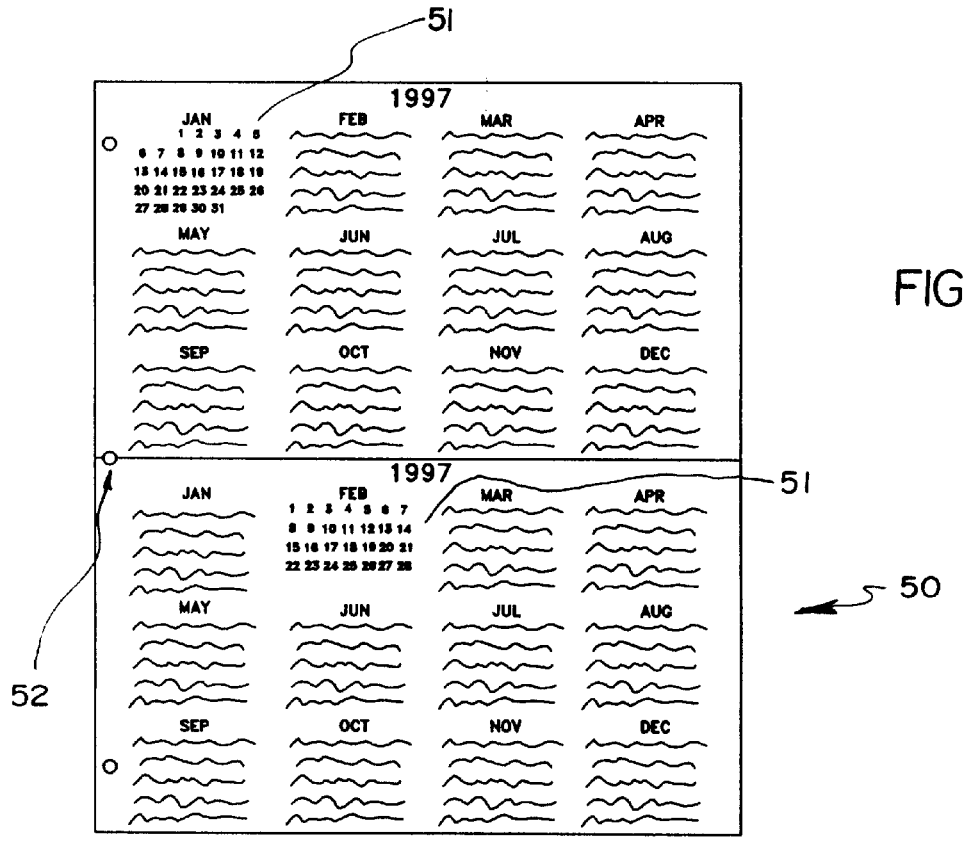
FIG. 7 is an illustration of the reference calendar of the present invention.

As best illustrated in FIG. 7, it can be shown that the reference calendar 50 has indicia 51 thereon representing a plurality of calendar months. The reference calendar 50 has a plurality of aligned holes 52 therein along an inner edge thereof. Each of the plurality of aligned holes 52 corresponds to one of the plurality of openable retaining rings 24. In an illustrative embodiment, the reference calendar 50 includes twenty-four (24) calendar months.

Figure 8:
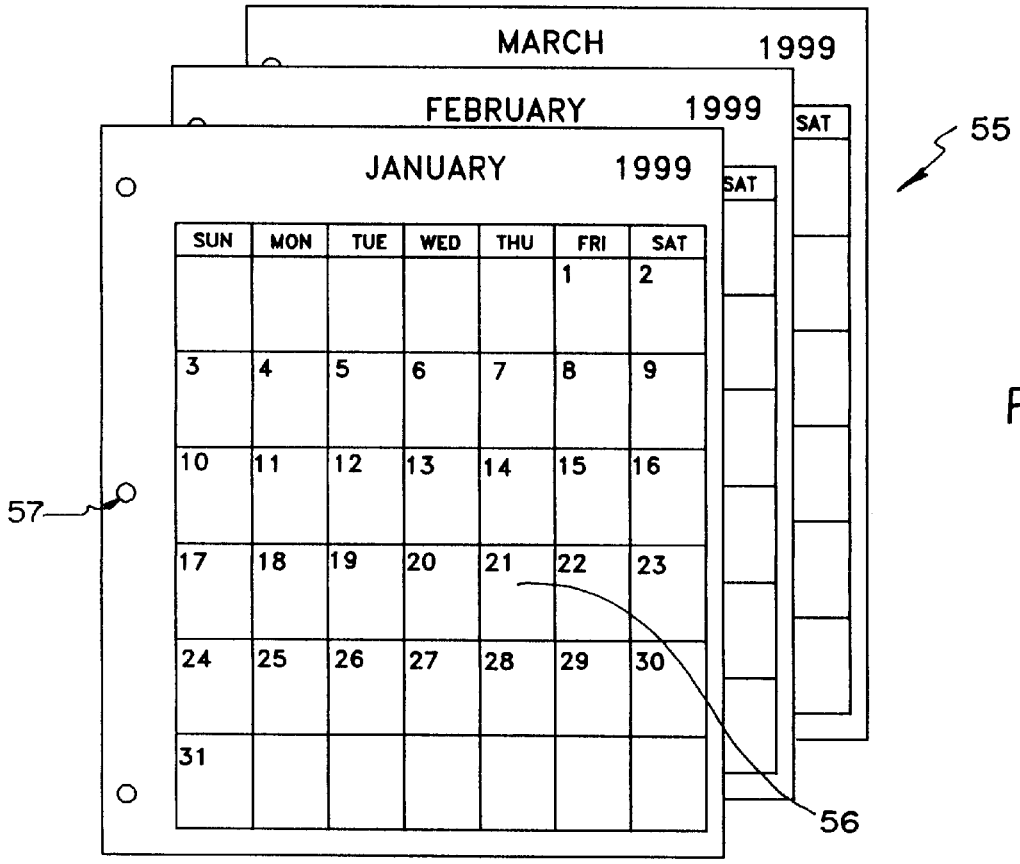
FIG. 8 is an illustration of the plurality of plurality of monthly planning calendars of the present invention.

As best illustrated in FIG. 8, it can be shown that each of the plurality of monthly planning calendars 55 have indicia 56 thereon representing an individual calendar month and include an area for each day of the individual calendar month in which notational information may be recorded. Each of the plurality of monthly planning calendars 55 has a plurality of aligned holes 57 therein along an inner edge thereof. Each of the plurality of aligned holes 57 corresponds to one of the plurality of openable retaining rings 24.

In use, the Organizing and Planning Device For Weddings 10 is used for storing and organizing pertinent information related to the wedding occasion. The pocket 33 of each of the pocketed dividers 30 is used for storing important documents, such as contracts and receipts, corresponding to one of the elements of the wedding occasion. For example, pertinent information regarding the photographer is stored in the pocket 33 of the pocketed divider 30 corresponding to the photographer. In addition, a business card of the photographer may be displayed in the business card pocket 38 of the pocketed divider 30 corresponding to the photographer. Alternatively, a notational information card 45 may be completed and displayed in the business card pocket 38 of the pocketed divider 30 corresponding to the photographer. As such, pertinent information regarding the photographer is stored in one location where it can be easily located and accessed.

The plurality of notational information sheets 40 are used for recording notational information including names, addresses, telephone numbers, and various gifts wherein the plurality of tabbed dividers 70 alphabetically separate the notational information sheets 40. The reference calendar 50 and the plurality of monthly planning calendars 55 are used for organizing and planning the wedding occasion, wherein the year of the monthly planning calendars 55 corresponds to the year of the wedding occasion. Each of the pocketed dividers 30, the notational information sheets 40, the reference calendar 50, the monthly planning calendars 55, and the tabbed dividers 70 can be independently removed and replaced by use of the openable retaining rings 24.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An organizing and planning device comprising:

a binder including a back cover, a front cover, a spine portion hingedly joining said back cover and said front cover, and a plurality of openable retaining rings mounted to said spine portion thereof;

a plurality of pocketed dividers each removably and replacably retained in said binder by said plurality of openable retaining rings, each of said plurality of pocketed dividers having element indicia marked thereon, each element indicia corresponding to an element of a wedding occasion;

wherein each pocketed divider includes a front sheet coupled to a back sheet along the full length of two sides of the front and back sheets and along a portion of two other sides of said front and back sheets, said element indicia being located on said front sheet, said front sheet having a straight fifth side not coupled to said back sheet and extending between respective coupling points on said two other sides to form a pocket therebetween such that a substantially triangular portion of said back sheet is exposed to thereby expose a triangular portion of any sheets inserted in said pocket;

wherein each of said plurality of pocketed dividers includes a tab disposed along an outer edge thereof, each tab being vertically offset from adjacent tabs so as to avoid complete overlap thereof, each tab having indicia thereon corresponding the indicia marked on said front sheet;

wherein each front sheet of said plurality of pocketed dividers includes a business card pocket adapted for receiving and displaying a business card;

a plurality of notational information cards for removable insertion into said pocketed dividers, each of said plurality of notational information cards having notational indicia thereon identifying notational categories and including an area adjacent thereto for accepting notational information;

a plurality of notational information sheets each removably and replacably retained in said binder by said plurality of openable retaining rings, each of said plurality of notational information sheets having indicia thereon identifying notational categories and including an area adjacent thereto for accepting notational information;

a plurality of tabbed dividers each removably and replacably retained in said binder by said plurality of openable retaining rings, each of said plurality of tabbed dividers including a tab disposed along an outer edge thereof, each tab vertically offset from adjacent tabs so as to avoid complete overlap thereof, each tab having alphabet indicia thereon corresponding to a letter of the alphabet;

a reference calendar removably and replacably retained in said binder by said plurality of openable retaining rings, said planning calendar having calendar indicia thereon representing a plurality of calendar months;

a plurality of monthly planning calendars each removably and replacably retained in said binder by said plurality of openable retaining rings, each of said plurality of monthly planning calendars having month indicia thereon representing an individual calendar month and including an area for accepting notational information for each day of said individual calendar month;

a calculator, a notepad, a storage pocket, and a loop for holding a writing instrument each mounted on an inner surface of said front cover for providing immediate access to said calculator, notepad, pocket and writing instrument upon opening said front cover, said loop being mounted such that said writing instrument is held adjacent to an upper edge of said front cover in a position offset from each of said retaining rings such that said retaining rings are prevented from contacting said writing instrument when said binder is in a closed position, said loop being mounted such that said writing instrument is held in a position substantially perpendicular to said spine to permit grasping an end of said writing instrument for removal thereof while said front cover is in said closed position;

said notepad being positioned adjacent said writing instrument and between a first adjacent pair of said retaining rings such that said notepad is prevented from contacting said retaining rings when said binder is in said closed position;

said calculator being positioned adjacent an outer edge of said front cover between said notepad and said outer edge of said front cover;

said storage pocket being positioned adjacent a lower edge of said front cover and between a second adjacent pair of said retaining rings such that said storage pocket is prevented from contacting said retaining rings when said binder is in said closed position; and a photo sleeve formed by an outer planar sheet coupled to an outer surface of said front cover on three sides thereof such that said photo sleeve includes an opening along one side thereof for allowing insertion of a photograph therein, said photo sleeve outer planar sheet having a substantially opaque border portion surrounding a transparent oval-shaped window therein for permitting viewing of a portion of said photograph when inserted in said photo sleeve, said border portion having indicia thereon.

* * * * *